US005803457A

United States Patent [19]

Smith

[11] Patent Number: 5,803,457

[45] Date of Patent: Sep. 8, 1998

[54] CHECKERS FOR TEAMS

[76] Inventor: Denis Martin Smith, R.R. 1, Box 65T, Williston, N. Dak. 58801

[21] Appl. No.: 915,404

[22] Filed: Aug. 20, 1997

[51] Int. Cl.[6] ..... A63F 3/02

[52] U.S. Cl. ..... 273/261

[58] Field of Search ..... 273/242, 260, 273/261

[56] References Cited

U.S. PATENT DOCUMENTS

| | | | |
|---|---|---|---|
| D. 55,455 | 6/1920 | Day | 273/261 X |
| 386,007 | 7/1888 | Gibford . | |
| 511,773 | 1/1894 | Higgins | 273/261 |
| 534,080 | 2/1895 | Preston | 273/261 |
| 694,509 | 3/1902 | Winckfield . | |
| 701,414 | 6/1902 | Standidge . | |
| 1,134,922 | 4/1915 | Smith | 273/261 |
| 1,202,191 | 10/1916 | King . | |
| 1,336,169 | 4/1920 | Stewart | 273/261 |
| 1,555,937 | 3/1925 | Billman . | |
| 2,614,842 | 10/1952 | Rice | 273/261 |
| 3,998,464 | 12/1976 | Poturalski . | |
| 4,037,843 | 7/1977 | Hoffman | 273/261 |
| 4,136,880 | 1/1979 | Rikon | 273/261 |
| 4,696,478 | 9/1987 | Farrell | 273/261 |
| 5,125,666 | 6/1992 | Adams | 273/261 |
| 5,513,849 | 5/1996 | Navin | 273/261 |

*Primary Examiner*—William E. Stoll
*Attorney, Agent, or Firm*—Curtis V. Harr

[57] ABSTRACT

A method of playing a two to four person checkerboard game utilizing a traditional game board consisting of 64 equally sized squares in an 8 by 8 matrix known as the battleground. An 8 by 3 matrix, known as a players home base, is attached to each of the four sides of the main game board, providing an additional area in which each players' game pieces are placed. Four sets of 12 game pieces in different colors are provided, allowing two to four players, or teams of players, each to play in a single game. The game utilizes a novel set of rules for kinging and jumping checkers.

5 Claims, 2 Drawing Sheets

CHECKERS FOR TEAMS

BACKGROUND OF THE INVENTION

The present invention relates to an improvement in the method by which the game of Checkers is played. Traditionally, the game of "Checkers" is played on a two-colored game board which is divided into 64 equally sized squares in an 8 by 8 matrix, each square being alternately colored. Each player begins the game with 12 playing pieces of the same color. The playing pieces are placed on opposite ends of the game board in the three rows directly in front of the player on alternate squares, such that 4 pieces are placed in each of the three rows on squares bearing the same color.

The object of the game is to block the opponents' game pieces from moving or by "capturing" the opponent's playing pieces; the winner is the last player with playing pieces remaining on the board. The players move their playing pieces forward one at a time, in a diagonal direction, such that the entire game is played using squares of the same color, and try to reach the opponent's side of the game board without being captured or blocked.

Capturing playing pieces is accomplished by jumping over an opponent's game piece to an open square on the other side of the captured game piece. Once a piece is captured by the opponent, it is removed from the game board. When all of the playing pieces of one player are "captured" and removed from the board, or blocked so that the player's piece(s) cannot be legally moved, the game is over.

If any one of a player's game pieces reaches the last row on the opposite side of the game board without being captured, it is "crowned" and another playing piece is placed on top of it. A "crowned" game piece can be moved more liberally, as it can be moved in either a forward or reverse direction, increasing the possibility of moves and lessening the opponent's ability to block the game piece.

An inherent disadvantage to this traditional method of playing the game is that the game is limited to play by two players. Additionally, because the players can only move in a forward direction until the pieces reach the other side of the game board, the strategy involved to win the game is limited, making the game unchallenging after extended play.

U.S. Pat. No. 1,555,937 (granted to Billman) provides a method for playing the game of checkers for up to 4 players using an extended game board and 4 sets of 12 game pieces each. The game is played on a game board that starts with equally-sized, alternatively colored squares arranged in a traditional 8 by 8 matrix which provides a central playing field. An additional row of squares surrounds this matrix, such that the center portion of the game board is a 10 by 10 matrix. Extending from each of the four sides of the game board is an additional 6 by 6 matrix, onto which each players' game pieces are placed to begin the game. The game pieces are arranged on alternating squares of the same color in the 4 rows closest to each player, three game pieces per row, such that three empty rows exist between the game pieces and the central playing field. The game is played with traditional checkers rules, with each player moving one playing piece per turn, one square at a time. While this method allows more than two players to participate in the game, the fact that the game pieces start several rows away from the central playing field causes the length of the game to be significantly increased. Each player must have at least 4 turns before any of his game pieces reach the central playing field, and several more turns must be completed before the players' game pieces interact and the strategic part of the game (capturing and/or blocking pieces) can begin.

U.S. Pat. No. 701,414 (granted to Standidge) employs a more simplistic game board for a multiple-player game consisting of a 7 by 7 square matrix as the central playing field, with a 6 by 3 matrix attached to each of the four sides of the playing field. Each players' 12 game pieces are lined up on alternate, similarly colored squares; four game pieces are placed on the row closest to the player, three in the second row, four on the third row. The twelfth game piece is placed in the center square of the first row of the central playing field.

U.S. Pat. No. 694,509 (granted to Winckfield) provides a method of play with a similar game board with slightly different dimensions. The game board consists of an 8 by 8 central matrix, with an 8 by 3 matrix attached to each of the four sides of the game board in which each players' game pieces are lined up at the beginning of the game. The unused space created on the sides of the 8 by 3 matrices is divided into 4 sections, each bearing the color of one set of game pieces. This area can be used by the players to determine at a glance how many of each players' game pieces have been captured and removed from the game board. Additionally, this game provides spool-shaped game pieces with small holes in the top, into which small flag-like devices can be inserted to designate which game pieces have reached the other side of the board and have become "crowned". However, the use of these game pieces, consisting of several small components is not desirable; as the small flags can be easily misplaced or lost. Because the shape of the game pieces does not easily lend itself to stacking, as is done in traditional checkers to designate "crowned" pieces, the loss of the flags can cause confusion and thus, detrimentally effect the play of the game. Finally, a player cannot be kinged in this game until reaching the opponents 8 by 3 matrices across the board, which may significantly lengthen the game.

U.S. Pat. No. 4,136,880 (granted to Rikon) provides another alternative method for playing the game of checkers using an extended game board and 4 sets of 12 game pieces each. The game board consists of equally-sized, alternatively colored squares arranged in a matrix with an odd number of rows and columns. The center 8 by 8 matrix of squares provides a central playing field, and the players' game pieces are lined up in the rows outside of the central playing field, such that the opposing sides of the playing field are offset from each other by one row or column. This arrangement provides an overlap of game pieces, limiting the movement of the overlapping game pieces. Although this method increases the challenge and complexity of the game, the overlap of the checkers may cause the player to find the game to be too difficult, thus eliminating the ability of certain players to participate in the game. Additionally, the offset of the squares creates a game board which is not symmetrical and is unappealing to the eye.

From the foregoing discussion, it can clearly be seen that it would be highly desirable to provide a method by which several players, either separately or as teams, could participate in a single game. Additionally, it would be desirable to provide an alternative method for playing Checkers which increases the difficulty of the game and makes the game more challenging for experienced players, yet is not so complicated as to exclude less sophisticated players from participating.

SUMMARY OF THE INVENTION

It is the primary objective of the present invention to provide a method for playing checkers which will allow more than two players to participate in a single game.

It is an additional objective of the present invention to provide a method for playing checkers with additional rules that increases the difficulty of the game by requiring players to employ new strategies to win the game, yet simple enough to allow all to play.

It is still a further objective of the present invention to provide a method of playing checkers with from two to four players, and allowing for team play or individual play as desired.

These objectives are accomplished by the use of a traditional game board consisting of 64 equally sized squares in an 8 by 8 matrix known as the battleground. An 8 by 3 matrix, known as a players home base, is attached to each of the four sides of the main game board, providing an additional area in which each players game pieces are placed. Four sets of 12 game pieces in different colors are provided, allowing four players, or teams of multiple players each, to play in a single game.

A piece may only move diagonally forward to the next unoccupied space, or an opponent may be captured by jumping diagonally forward if the opponent is adjacent and there is an unoccupied space on the other side of the opponent's piece. A piece may be jumped only after the jumping piece first lands on at least one square of the battleground. For example, you cannot move a piece directly from its home base to an adjacent player's home base. A player must jump their opponent if a space is unoccupied, and remove the jumped piece from the board. If another opponent is still adjacent and diagonally forward, and there is a space unoccupied on the other side of his piece, than you must continue jumping forward removing the captured pieces. Only up to four pieces can be captured on a player's turn. A piece can move diagonally forward in two direction s. When capturing, a piece can change direction as long as it moves diagonally forward. If a player is able to capture, he must do so instead of making a non-capturing move. A player may choose to capture one piece instead of two, but a capturing piece may stop only when unable to make additional captures.

When a piece reaches, or passes on a jump, the opposite side of the battleground, the kings row, it is crowned to a king. The kings row extends three squares into the adjacent home bases, thus, forming a kings row 14 squares across. A king may move in any direction as in standard checkers.

For a better understanding of the present invention, reference should be made to the drawings and the description in which there are illustrated and described preferred embodiments of the present invention.

DESCRIPTION OF THE PREFERRED EMBODIMENT

Figure 1:
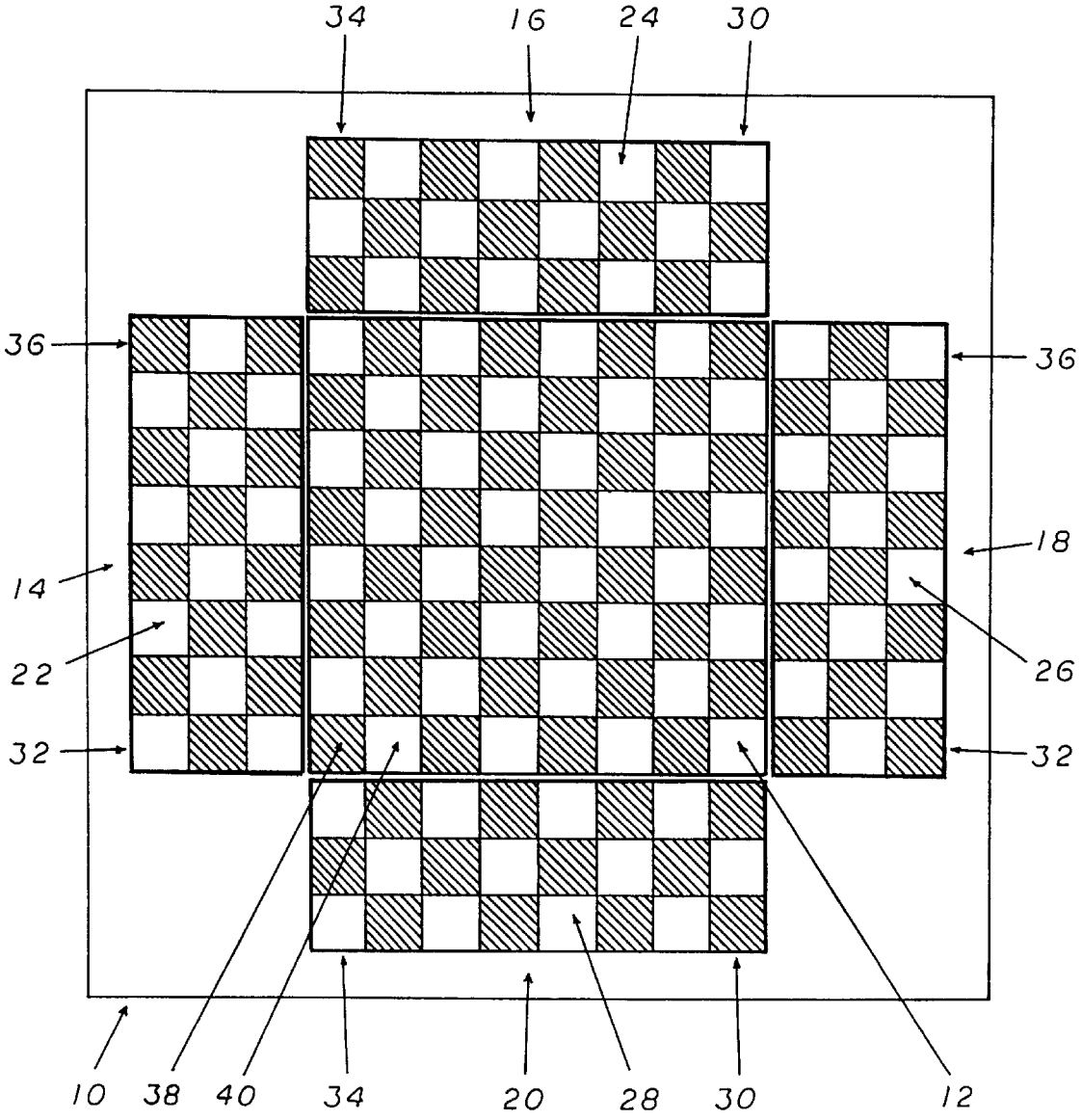
FIG. 1 is a plan view of the checkers for teams game board showing the manner in which said board is configured.
Figure 2:
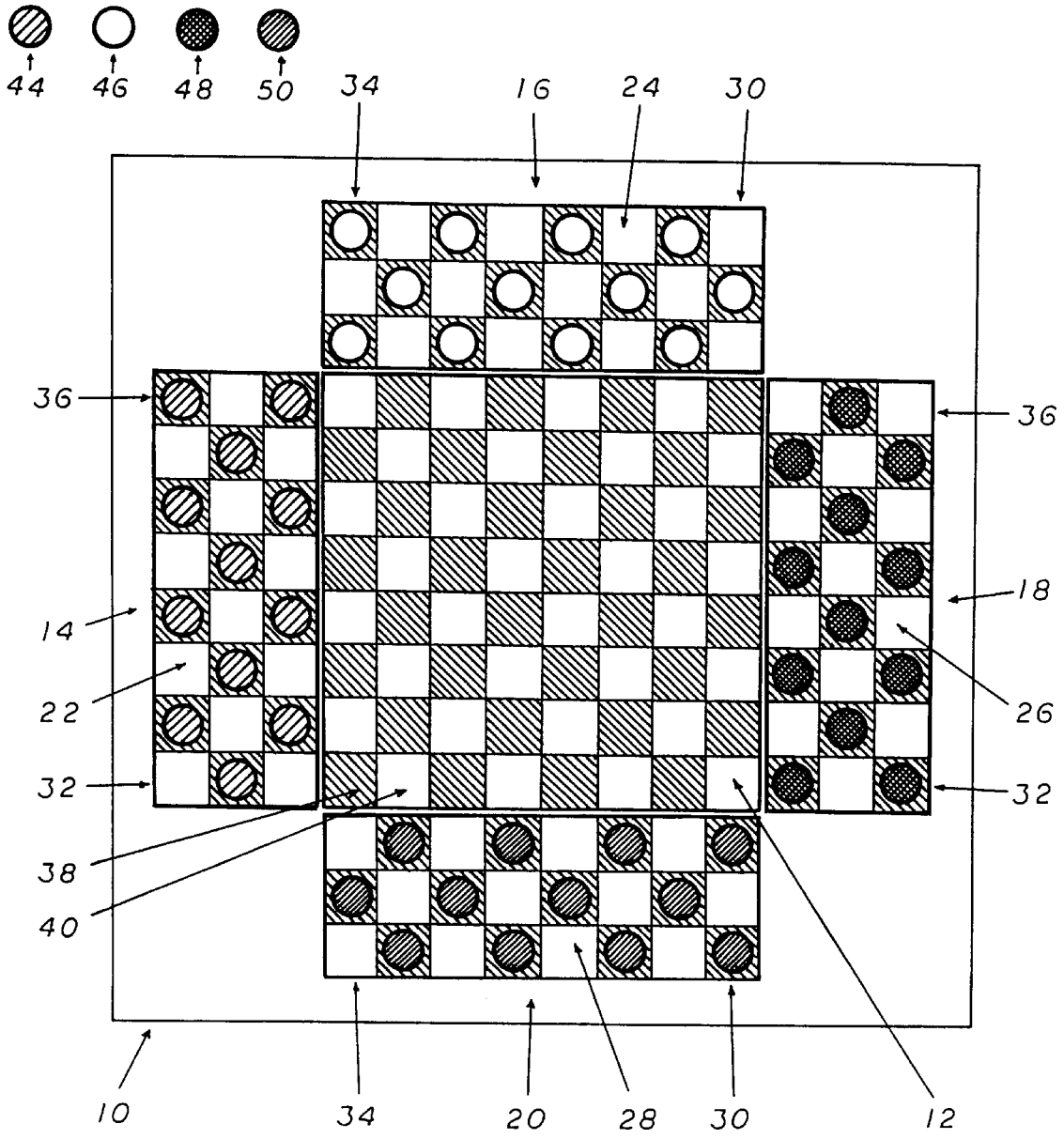
FIG. 2 is a plan view of the present invention showing it configured for commencement of play.

Referring now to the drawings, and more specifically to FIGS. 1 and 2, the present invention comprises a game board 10 which is primarily constructed of spongy plastic material, although any suitable material such as paper, cardboard, wood or any other flat material can be used. The game board is made up of a central, square battleground 12. The battleground 14 consists of 64 equal squares, thirty two of which are black or dark colored playing squares 38 and the remaining thirty two squares are white or light colored non-playing squares 40. The playing and non-playing squares, 38 and 40, are arranged in alternate fashion in rows and columns to form the square battleground 12 having eight squares, four of each the playing squares 38 and non-playing squares 40, on each of the four outside edges. It is in the battleground that play is engaged and where the winner of the game is decided.

Extending out from the outside edges of the battleground are home bases one-four, 22, 24, 26 and 28, respectively. The home bases one-four, 22, 24, 26 and 28, are rectangular extensions formed by twelve alternating playing squares 38 and twelve alternating non-playing squares 40 being made up of three rows of eight squares each. Each of the playing squares on the inside edge, or the edge closest to the battleground 12, of an individual home base are lined up adjacent to a non-playing square 40 of the battleground and vise versa. Therefore, the alternating pattern of playing squares 38 and non-playing squares 40 of the battleground 14 is carried through to the home bases one-four, 22, 24, 26 and 28.

Prior to the start of a game, two to four players are assigned a position on the game board 10 and a specific color of twelve playing pieces. For example, in a four player game, player one would be assigned position one 14 and the light brown playing pieces 44, player two would be assigned position two 16 and the white playing pieces 46, player three would be assigned position three 18 and the black playing pieces 48 and player four would assigned position four 20 and the red playing pieces 50. Each player then places his twelve playing pieces on the playing squares 38 within his assigned home base. It is important to note that any appropriate colors may be utilized.

Play is commenced by player one diagonally moving a single playing piece one place from a playing square 38 within home base one 22 to a playing square 38 in the battlefield 12. This process is then repeated by each of the players in a clock-like fashion and continues until the game is completed. Each player continues to move his pieces forward while attempting to capture the other player's pieces by jumping one of his playing pieces over an opponent's to an open playing square 38. An additional objective is to move one's playing pieces forward to the row of playing squares 38, the "king row", located at the opposite edge of the battleground 12 from one's starting position. By accomplishing this, a player's pieces are "kinged" which allows those pieces to be moved in all directions, as in standard checkers. Unlike other forms of the game, the present invention's "king rows" extend outwardly into the home bases of the two players located on either side of him. Therefore, position one's 14 king row 30 is located directly in front of home base three 26 and extends laterally into home base two 24 and home base four 28. Position two's 16 king row 32 is located directly in front of home base four 20 and extends laterally into home base one 22 and home base three 26. Position three's 18 king row 34 is located directly in front of home base one 22 and extends laterally into home base two 24 and home base four 28. Position four's 16 king row 36 is located directly in front of home base two 24 and extends laterally into home base one 22 and home base three 26.

The present two to four player checkers game is applicable to the toy and game industry. It is also applicable to the video and computer game industry. It is particularly attractive to checkers players. It provides a fun, fast paced game that requires more and newer strategies than standard checkers Moreover, more people can enjoy the game by playing together, or more skilled players can challenge two or three players. Additionally, teams can play against each other. The invented two to four player checkers can also be implemented in a video game, arcade game or any other computer-based system having a visual display. It is particularly applicable to network games where several people play against each other over a computer network or phone lines.

When applied to a video, computer or arcade game, the invented method would be embodied in software, firmware and/or hardware. Any software code capable of implementing the movement and capturing restrictions of the invented game can be used. Additionally, the display of a video computer or arcade game may present the game board in a two-dimensional image or a three-dimensional image.

Although the present invention has been described in considerable detail with reference to certain preferred versions thereof, other versions are possible. Therefore, the spirit and scope of the appended claims should not be limited to the description of the preferred versions contained herein.

What is claimed is:

1. A method of playing checkers by two three or four players, each player having a distinguishable set of checkers, played on a game board having a main playing area comprising a square matrix of eight by eight alternating colored playing spaces forming a battleground with three additional rows of eight alternately colored playing spaces adjacent to each side of the battleground forming four home bases, the method comprising:

placing each players set of checkers on the game board so that each different set occupies three rows adjacent one side of the battleground in a conventional checkers arrangement;

each player moving, in turn, one of his checkers anywhere on the game board according to standard checkers;

jumping, during moving, other player's checkers anywhere on the game board according to standard checkers rules except that a first player may not jump an opposing player from said first players home base to another home base until the first player's checker has first landed on one square in the battleground;

kinging a checker, when a player's playing piece reaches, or passes on a jump, the opposite king row of the battleground with the king row extending into each adjacent home base forming a king row that is 14 alternating squares wide, a checker that has been kinged being able to move according to the standard rules of checkers;

removing a player from the game when all of his checkers have been jumped or he can no longer move any of his remaining pieces; and continuing the steps of moving, jumping, kinging when necessary, and removing a player when necessary until only one player remains and is the winner.

2. A method of playing checkers as in claim 1 wherein the step of jumping must be undertaken if possible and must be continued by jumping up to four of the opponents checkers if possible.

3. A method of playing checkers as in claim 2 wherein the step of jumping, a player may choose to jump one checker instead of multiple checkers but a jumping checker may stop only when unable to make additional jumps.

4. A method of playing checkers as in claim 3 further comprising the step of forming teams between the players.

5. A method of playing checkers as in claim 4 wherein the step of jumping, a player does not have to jump another player of his team but may if he so chooses.

* * * * *